United States Patent [19]

Britton

[11] 4,210,850

[45] Jul. 1, 1980

[54] CIRCUITS FOR OPERATING ELECTRIC DISCHARGE LAMPS

[75] Inventor: John Britton, Sevenoaks, England

[73] Assignee: The General Electric Company Limited, London, England

[21] Appl. No.: 915,614

[22] Filed: Jun. 15, 1978

[30] Foreign Application Priority Data

Jun. 27, 1977 [GB] United Kingdom ..... 26771/77

[51] Int. Cl.[2] ..... H05B 41/16

[52] U.S. Cl. ..... 315/290; 315/240; 315/244; 315/DIG. 2

[58] Field of Search ..... 315/208, 244, 243, 283, 315/289, DIG. 2, DIG. 5, DIG. 7, 240, 290

[56] References Cited

U.S. PATENT DOCUMENTS

| | | | |
|---|---|---|---|
| 3,679,936 | 7/1972 | Moerkens | 315/289 X |
| 3,917,976 | 11/1975 | Nuckolls | 315/208 X |
| 3,976,910 | 8/1976 | Owens et al. | 315/208 X |
| 4,015,167 | 3/1977 | Samuels | 315/DIG. 2 |

FOREIGN PATENT DOCUMENTS

| | | | |
|---|---|---|---|
| 1398383 | 6/1975 | United Kingdom | 315/DIG. 2 |

*Primary Examiner*—Eugene R. LaRoche

*Attorney, Agent, or Firm*—Kirschstein, Kirschstein, Ottinger & Cobrin

[57] ABSTRACT

A circuit for operating an electric discharge lamp from an a.c. supply wherein a burst of high voltage pulses for starting the lamp is generated during each cycle or half cycle of the supply by rapidly turning on and off an electronic switch, e.g. a triac, connected between a tapping point on a ballast inductance and an input terminal of the circuit.

6 Claims, 4 Drawing Figures

CIRCUITS FOR OPERATING ELECTRIC DISCHARGE LAMPS

This invention relates to circuits for operating electric discharge lamps.

It is an object of the present invention to provide such a circuit suitable for use with a low pressure sodium lamp and capable of achieving more reliable starting of such a lamp and stable operation while the lamp runs up to full current than has hitherto been achieved by circuits of comparable cost.

According to the present invention there is provided a circuit for operating an electric discharge lamp comprising: a pair of input terminals for connection to an alternating current supply; a pair of output terminals for connection across the lamp; a reactive ballast impedance connected between one of the input terminals and one of the output terminals; a connection between the other input terminal and the other output terminal; a controllable electronic switching device connected between a tapping point on the ballast impedance and said other input terminal, or said other output terminal or a point on said connection there-between; and a triggering circuit for said switching device arranged to render said switching device alternately non-conducting and conducting several times during each of at least one set of alternate half cycles of the supply voltage when the lamp has not fired, thereby to produce a burst of high voltage pulses between the output terminals for starting the lamp.

In one particular circuit in accordance with the invention the triggering circuit comprises: a pair of resistances connected in series between said tapping point and said other input terminal, or said other output terminal or a point on said connection there-between; a capacitance connected across one of said resistances; and a voltage sensitive breakdown device connected between the junction between said resistances and the control electrode of said switching device.

In a preferred circuit in accordance with the invention capacitance is connected in series with the main current path through the switching device.

Figure 1:
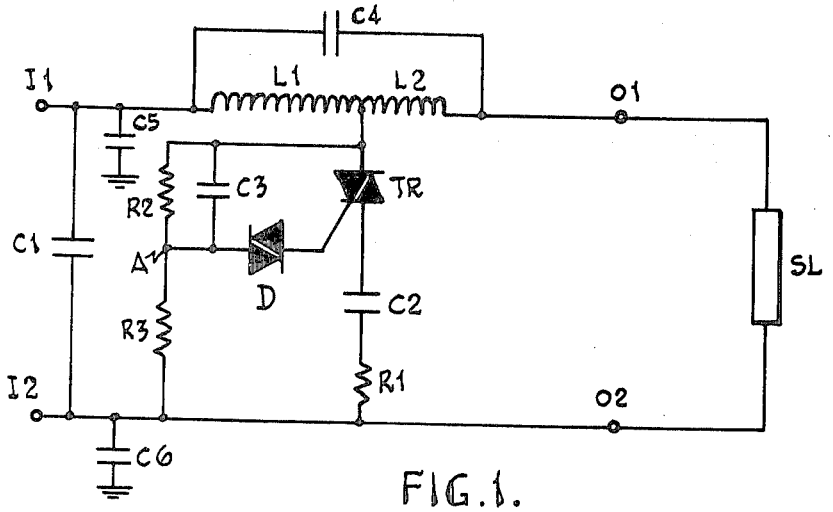
Figure 2A:
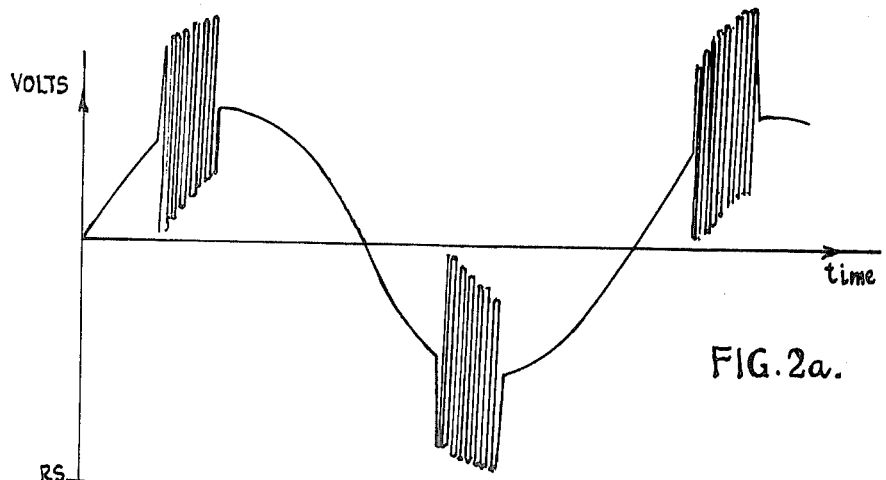
Figure 2B:
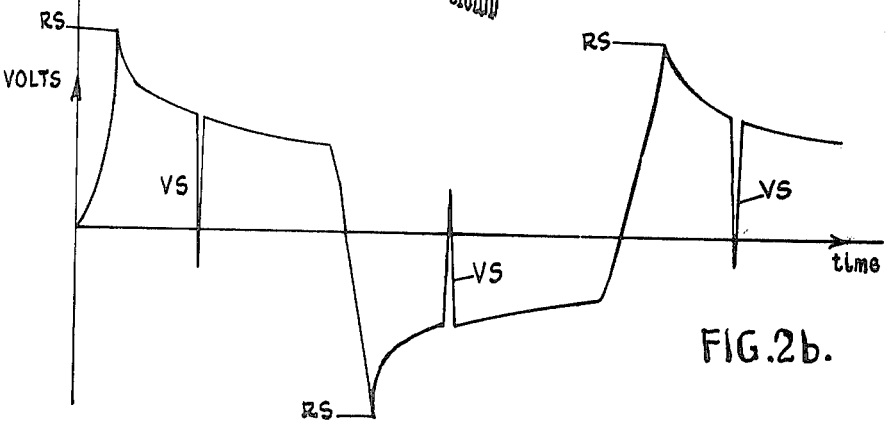
Figure 3:
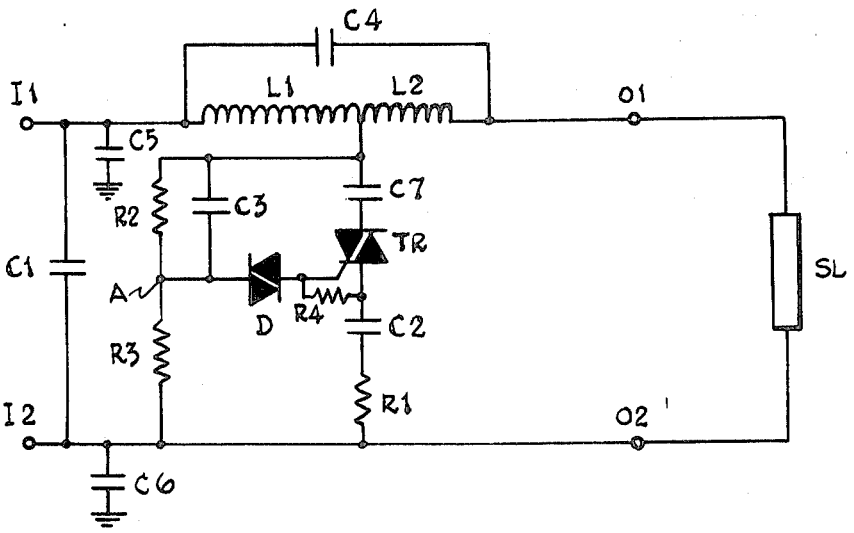

Two circuits in accordance with the invention will now be described, by way of example, with reference to the accompanying drawings in which:

FIG. 1 is a diagram of one circuit;

FIGS. 2*a* and 2*b* show the waveforms of voltages appearing in the circuit of FIG. 1 in operation; and FIG. 3 is a diagram of the other circuit.

Referring to FIG. 1, the circuit includes a pair of input terminals I1 and I2 between which an alternating current supply (not shown) is connected in operation, and a pair of output terminals 01 and 02 between which a low pressure sodium lamp SL is connected in operation.

A reactive ballast impedance comprising a tapped inductor L1, L2 is connected between the input terminal I1 and the output terminal 01, and the other input terminal I2 is directly connected to the other output terminal 02.

A power factor capacitor C1 is connected between the input terminals I1 and I2.

A triac TR, a capacitor C2, and a small value resistor R1 are connected in series between the tapping point on the inductor L1, L2 and the terminal I2. The triac TR is provided with a trigger circuit comprising a voltage sensitive breakdown device in the form of a diac D connected between the control electrode of the triac TR and the junction between two resistors R2 and R3 connected in series between the tapping point on the inductor L1, L2 and the terminal I2, the resistor R2 being shunted by a capacitor C3.

The whole of the inductor L1, L2 is shunted by a capacitor C4 and further capacitors C5 and C6 are connected between the terminals I1 and I2 respectively and ground.

In operation of the circuit, when the supply voltage is applied to the terminals I1 and I2, before the lamp SL has struck, the full supply voltage appears across the trigger circuit comprising components R2, R3, C3 and D. The capacitor C3 therefore charges up and the potential of the junction point A between resistors R2 and R3 rises until the diac D breaks down. This causes capacitor C3 to discharge rapidly via triac TR and the potential at point A to fall below the maintaining voltage of the diac D. When the diac D stops conducting the capacitor C3 rapidly recharges and the potential of point A rises again until diac D breaks down again and the cycle is repeated. Hence, as the supply voltage rises in each half cycle several current pulses are supplied to the control electrode of the triac in rapid succession.

The trigger circuit comprising components R2, R3, C2 and D is designed in conjunction with the characteristics of the triac TR employed in the circuit so that the firing current delivered to the triac when the diac D breaks down is insufficient to turn the triac fully on, so that the current between the main electrodes of the triac follows the current in the diac. Hence, before the lamp SL ignites, during each half cycle of the supply voltage, as the supply voltage rises, a burst of current pulses is produced in the inductor L1, producing a corresponding burst of large amplitude voltage pulses between the terminals 01 and 02, as illustrated in FIG 2*a*.

The trigger circuit also effects a phase delay of the voltage at point A with respect to the supply voltage so that there is a short delay before the onset of pulses at terminals 01 and 02 in each half cycle of the supply voltage.

After the lamp SL has fired in response to the large amplitude voltage pulses produced between the terminals 01 and 02, as the lamp SL is running up to full current, the voltage between terminals 01 and 02 has the waveform shown in FIG. 2*b*.

During this period of operation, i.e. during running up to full current, the lamp restrike voltage RS is initially sufficiently large to cause the diac D to break down (after the above-mentioned delay) and cause the triac TR to conduct, thereby producing a rapid fall in the voltage between terminals 01 and 02, as illustrated in FIG. 2*b* by voltage spikes VS. The value of capacitor C2 is chosen to reduce the width of this spike to a minimum. It will be appreciated that after the lamp SL has restruck in each half cycle the voltage across trigger circuit R2, R3, C3, D rapidly becomes too low to cause further breakdown of the diac in that half cycle.

As the lamp approaches full current and the sodium takes a role in the discharge mechanism the restrike voltage peaks RS are reduced and no further breakdown of the diac D or consequent firing of the triac TR occurs.

The capacitors C4, C5 and C6 together with the power factor correction capacitor C1 act as a filter to suppress any radio frequency voltages that may be generated in operation of the circuit.

The capacitor C4 also acts as a stabilising capacitor during run-up of the lamp to full current by aiding restrike of the lamp. In addition, the capacitor C4 together with the inductor L1, L2 acts as a circuit tuned roughly to the frequency of the pulses produced by the trigger circuit, and thereby reduces the likelihood of the triac becoming fully turned on when the diac breaks down.

In one particular embodiment of the circuit of FIG. 1 for operating a 35 watt sodium lamp from a 240 volt, 50 Hz supply, details of the circuit are as follows:

| | | |
|---|---|---|
| Capacitors | C1 | 6.5 μfd |
| | C2 | 0.47 μfd |
| | C3 | 0.1 μfd |
| | C4 | 0.01 μfd |
| | C5 | 0.02 μfd |
| | C6 | 0.02 μfd |
| Resistors | R1 | 2.2 ohms |
| | R2 | 10 kilohms |
| | R3 | 45 kilohms |
| Inductance | L1 | 0.6 Henries |
| | L2 | 6.0 millihenries |
| Diac | D | RCA type D32027 |
| Triac | TR | RCA type T2801D |

In this arrangement in which the diac D has a breakdown voltage of 32 volts and a maintaining voltage of between 3 and 4 volts the bursts of starting pulses produced each half cycle have a frequency of a few kilocycles.

It will be appreciated that the frequency of these pulses is essentially dependent on the values of components R2, R3 and C3; the frequency may thus conveniently be set by appropriate selection of their values. The value of the capacitor C2 is selected in dependence on the required energy of the pulses.

It will be appreciated that for satisfactory operation of the circuit the current flowing between the main electrodes of the triac in response to each starting pulse must be sufficiently small and short to prevent the triac being turned fully on. Thus, satisfactory operation of the circuit of FIG. 1 is dependent on the characteristics of the triac.

In a modification of the circuit of FIG. 1 to reduce this dependence, a further capacitor may be connected between the triac and the tapping point on inductor L1, L2. With such a further capacitor present the rate at which the current between the main electrodes of the triac decays is increased thereby reducing the time which current flows in the triac in response to each starting pulse.

In a further such modification, a low-valued resistor is connected between the control electrode and a main electrode of the triac to speed up turn-off of the triac.

A circuit incorporating both these modifications is shown in FIG. 3, the further capacitor being referenced C7 and the low valued resistor being referenced R4, the circuit being otherwise identical to that shown in FIG. 1.

It will be understood that whilst the circuits described by way of example use a bidirectional switching device and produce a burst of starting pulses every half cycle, in other circuits in accordance with the invention the switching device may be unidirectional so that starting pulses are produced only every alternate half cycle.

I claim:

1. A circuit for operating an electric discharge lamp comprising:
   - (A) a pair of input terminals for connection to an alternating current supply;
   - (B) a pair of output terminals for connection across the lamp;
   - (C) a reactive ballast impedance connected between one of the input terminals and one of the output terminals, said ballast impedance having a tapping point;
   - (D) a connection between the other input terminal and the other output terminal;
   - (E) a controllable electronic switching device connected between said tapping point and said other input terminal; and
   - (F) a triggering circuit for said switching device comprising:
     - (i) a pair of resistances connected in series directly between said tapping point and said other input terminal;
     - (ii) a capacitance connected across one of said resistances; and
     - (iii) a voltage sensitive breakdown device connected between the junction between said resistances and the control electrode of said switching device;
   - (G) the triggering circuit rendering said switching device alternately non-conducting and conducting several times during each of at least one set of alternate half cycles of the supply voltage when the lamp has not fired, thereby to produce a burst of high voltage pulses between the output terminals for starting the lamp.

2. A circuit according to claim 1 wherein a capacitance is connected in series with the main current path through the switching device between the switching device and said tapping point on the ballast impedance.

3. A circuit according to claim 1 wherein a capacitance is connected in series with the main current path through the switching device between the switching device and said other input terminal or said other output terminal or a point on said connection therebetween.

4. A circuit according to claim 1 wherein a low-valued resistance is connected between the control electrode and a main electrode of said switching device.

5. A circuit according to claim 1 wherein said switching device is a bidirectional switching device and said triggering circuit is arranged to render said switching device alternately non-conducting and conducting several times during each half cycle of the supply voltage when the lamp has not fired.

6. A circuit according to claim 1 in combination with a low pressure sodium lamp connected across said output terminals of the circuit.

* * * * *